United States Patent [19]

Brannan et al.

[11] 4,104,133

[45] Aug. 1, 1978

[54] METHOD OF IN SITU PLATING OF AN ACTIVE COATING ON CATHODES OF ALKALI HALIDE ELECTROLYSIS CELLS

[75] Inventors: James R. Brannan, Painesville; Irving Malkin, University Heights; Claude M. Brown, Perry, all of Ohio

[73] Assignee: Diamond Shamrock Corporation, Cleveland, Ohio

[21] Appl. No.: 819,458

[22] Filed: Jul. 27, 1977

[51] Int. Cl.[2] ..... C25D 5/02; C25D 5/48; C25D 7/04

[52] U.S. Cl. ..... 204/25; 204/26; 204/35 R; 204/43 Z; 204/43 T

[58] Field of Search ..... 204/25, 26, 43 Z, 43 T, 204/35 R

[56] References Cited

U.S. PATENT DOCUMENTS

| | | | |
|---|---|---|---|
| 1,759,171 | 5/1930 | Soderberg et al. | 204/26 |
| 2,726,201 | 12/1955 | Prine | 204/26 |
| 3,385,363 | 5/1968 | Hamby, Jr. et al. | 204/26 |
| 3,857,764 | 12/1974 | Jumer | 204/26 |

FOREIGN PATENT DOCUMENTS

| | | | |
|---|---|---|---|
| 766,676 | 1/1957 | United Kingdom | 204/26 |

*Primary Examiner*—R. L. Andrews
*Attorney, Agent, or Firm*—Stephen A. Littlefield

[57] ABSTRACT

An active metal coating which lowers the hydrogen discharge overpotential at the cathode in the electrolysis of aqueous alkali metal halide solutions is deposited on the cathode tubes of a cathode can of an electrolysis cell without the removal of the tubes from the can. Plating solution and anodes of plating metal are placed inside a cathode can and the components are electrically connected so as to deposit an active coating onto the cathode tubes. The plating metal is preferably an alloy of nickel and zinc and the process involves the final step of leaching the zinc component of the alloy deposit from the plated cathode tubes to provide a porous, active nickel surface which results in a reduction of the hydrogen discharge overpotential for the electrolysis of alkali metal halides, particularly sodium chloride.

6 Claims, 7 Drawing Figures

METHOD OF IN SITU PLATING OF AN ACTIVE COATING ON CATHODES OF ALKALI HALIDE ELECTROLYSIS CELLS

This invention relates to the art of chlorine-caustic electrolytic cells, and more particularly to a method of depositing an active coating on the cathodes of an electrolytic cell which coating results in a reduction in the hydrogen discharge overpotential for the electrolysis reaction.

BACKGROUND OF THE INVENTION

In the electrolysis of aqueous alkali metal halide solutions in electrolytic cells having a diaphragm or membrane separator, the applied voltage required is the total of the decomposition voltage of the compounds being electrolyzed, the voltage required to overcome the resistance of both the electrolyte and the electrical connectors of the cell, and the overpotential required to overcome the passage of current at the surface of the cathode and anode. Such overpotential is related to such factors as the nature of the ions being charged or discharged, the current density at the electrode surface, the base material from which the electrode is constructed, the surface formation of the electrode, i.e., whether the electrode is smooth or rough, the temperature of the electrolyte, and the presence of impurities in the electrolyte and the electrodes. At the present time, knowledge of the phenomenon of discharge overpotential is not fully understood. It has been observed that there is a characteristic overpotential for each particular combination of discharging ion, electrode, electrolyte, current density, etc.

Because of the large quantities of chlorine and caustic required by a modern society, millions of tons of these materials are produced, principally by electrolysis of aqueous solutions of sodium chloride, each year. A reduction of as little as 0.05 volts in the working voltage of a cell translates into a meaningful economic savings, especially in the light of today's increasing power costs and energy conservation measures. As a result, the electrochemical industry is constantly in search of means which will reduce the voltage requirements for such electrolytic processes.

The development of the dimensionally stable anode and coatings therefor have resulted in a reduction in the anode and cathode spacing within electrolysis cells, this advance resulting in a large reduction in the voltage since electrolyte resistance is reduced within the narrow space between the electrodes.

Cathodes for electrolysis are generally made of wire screening, perforated plate or steel mesh material because of the low cost of such material and its resistance to the caustic environment in the catholyte. Further, hydrogen embrittlement, a problem with valve metal substrates, is avoided.

Various coatings have been proposed for depositing on the cathode mesh which coating reduces the hydrogen discharge overpotential for the cathodic reaction.

Japanese patent application publication No. 6611, published Aug. 7, 1956, describes a coating for electrodes used in the electrolysis of water, which coating comprises an alloy mixture or nickel or a nickel compound and zinc, coating the surface of the electrodes. The zinc component of the alloy mixture is then leached from the coating to give a cracked and porous surface which is principally nickel, which coating results in a lowering of the hydrogen overpotential for the electrolysis of water.

Similarly, Hahndorff, U.S. Pat. No. 3,272,728, describes a method for producing activated electrodes for water electrolysis wherein a nickel-zinc alloy is electrodeposited on the electrode surface to a thickness of between 30 and 50 microns. The coating is then leached in a sodium hydroxide solution to remove the zinc component and leave a porous Raney nickel surface on the electrode. This porous surface results in a lowering of the total discharge overpotential for hydrogen and oxygen of approximately 0.2 to 0.3 volts.

Canadian Pat. No. 955,645, discloses a leached nickel-zinc electro-deposit on fuel cell anodes as the base for the chemical deposition of a noble metal catalyst.

Strasser, U.S. Pat. No. 3,941,675, describes a bipolar electrolytic cell having bipolar electrodes therein which are coated on their cathode side with a nickel-phosphorous coating, which coating acts to reduce the hydrogen overpotential at the cathode surface.

The difficulty with the above-disclosed cathode coatings is that they have a relatively limited life and, after a period of six months to two years, these coatings have deteriorated to a point where they no longer effect any reduction in the hydrogen overpotential. At that point, the electrolytic cells must be completely disassembled so that the cathodes may be removed and replaced with new, coated cathodes or so that the old, spent cathode coatings may be renewed. The economics of this procedure have precluded commercialization of these processes.

SUMMARY OF THE INVENTION

In accordance with the present invention, a coating which lowers the hydrogen discharge overpotential on the cathode surface of an electrolysis cell is deposited in situ by opening a cathode can having a plurality of spaced parallel cathode tubes therein, positioning plating metal anodes adjacent the cathodes in situ within the can, adding plating electrolyte to the electrolysis cells so as to surround the anodes and cathodes therewithin and electrically connecting the anodes and cathodes so as to deposit an active coating on the surface of the cathodes. The anodes are then removed and the plating electrolyte pumped out of the electrolytic cell at which point the cell may be returned to production of chlorine and caustic.

Further in accordance with the invention, following the step of removing the plating electrolyte from the electrolytic cells, a solution of sodium hydroxide is pumped into the electrolytic cell so as to leach one component of the coating from the coating layer.

Further in accordance with the invention, the coating comprises a nickel-zinc alloy.

It is therefore a principal object of this invention to provide a method whereby an activated coating for the reduction of hydrogen overpotential is deposited on cathodes within an electrolytic cell in situ without the necessity and expense of removing the cathodes from the cell resulting in a lengthy production interruption.

It is a further object of this invention to provide a method whereby an active nickel-zinc alloy coating may be applied to cathodes for the electrolysis of sodium chloride brine solutions without the necessity of removing the cathode tubes from the electrolytic cell.

These and other objects of the invention will become apparent to those skilled in the art upon the reading and understanding of the specification and claims.

BRIEF DESCRIPTION OF THE DRAWINGS

The invention will be described in the more limited aspects of a preferred embodiment as illustrated in the appended drawings which form a part of this specification and in which.

DETAILED DESCRIPTION OF THE PREFERRED EMBODIMENTS AND THE DRAWINGS

Figure 1:
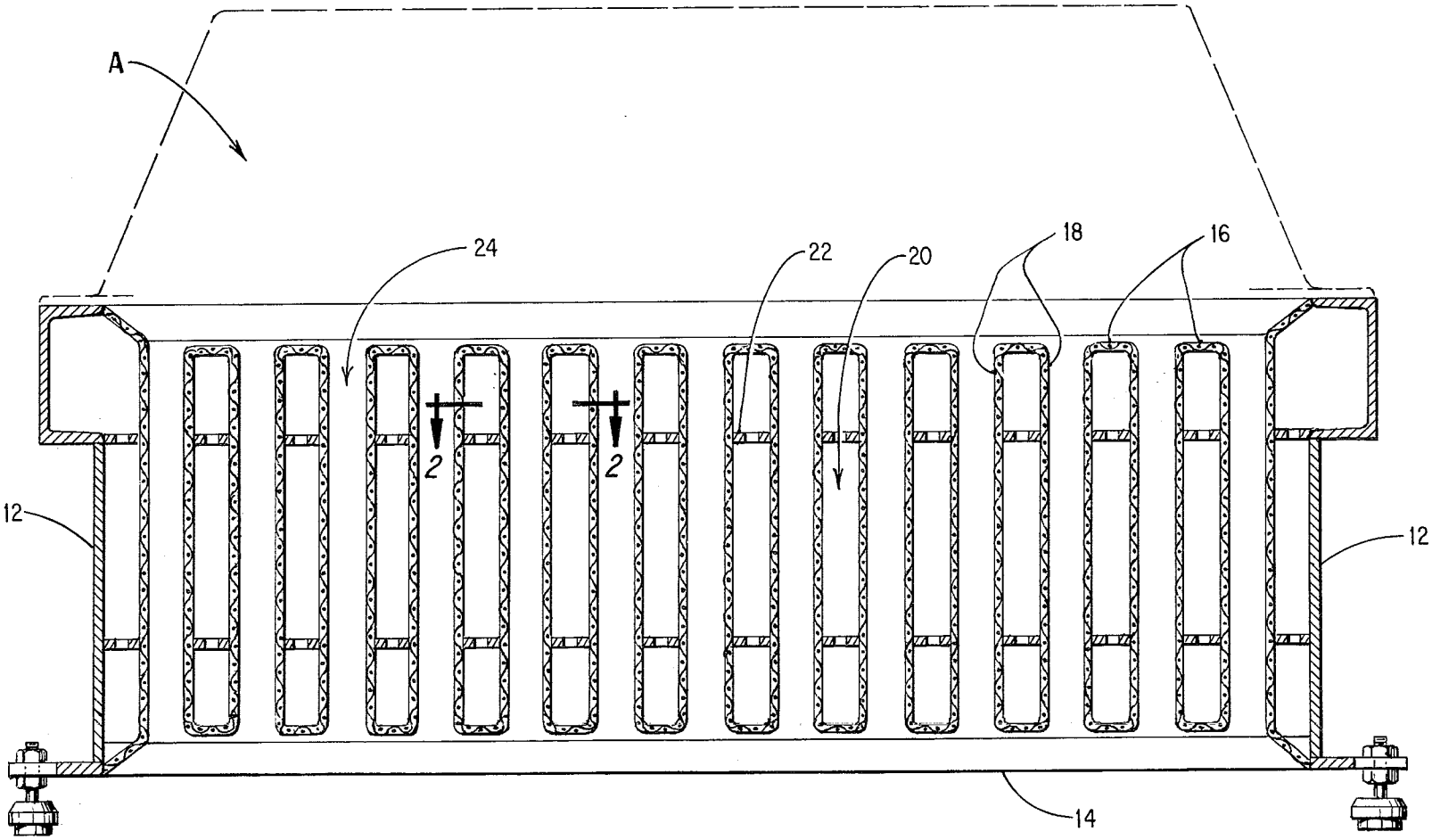
FIG. 1 is a side elevational view of an electrolytic cell for the production of chlorine and caustic in which portion of the electrolytic cell have been removed.

Referring now to the drawings in greater detail which illustrate a preferred embodiment of the invention only and should not be construed as a limitation upon same, FIG. 1 shows an electrolysis cell A of well known construction having a pair of parallel side walls 10, only one being shown in this view, and a pair of end walls 12 and a bottom portion 14. Disposed perpendicularly to side walls 10 and transverse to the cell are a plurality of parallel, vertical cathode tubes 16 each comprising a pair of parallel, planar mesh portion 18 and an interior space 20 therebetween. A plurality of horizontal parallel spacer members 22 are desposed between pairs of mesh 18 and act to form cathode members 16.

In the normal operation of electrolysis cells, electrolysis anodes are placed intermediate the spaced cathode tubes 16 in spaces 24 and a cap 26, indicated in phantom lines, is positioned over the cell for containing gaseous electrolysis products evolved at the anodes. Since these components do not in any way contribute to the present invention, and in fact, would interfere therewith, these portions of a normal electrolysis cell A are not shown in the drawings.

The cathode 16 may be made of any electrically conductive substrate material having the needed mechanical properties and chemical resistance to the electrolyte solution in which it is to be used. Illustrative materials that may be used as cathode substrates are iron, mild steel, stainless steel, titanium, nickel and the like. Normally, the cathode substrate will have a perforated structure such as metal screen, expanded metal mesh, perforated metal, and the like, to facilitate the deposition of a diaphragm and the flow of electrolyte therethrough. Because of its low cost, coupled with good strength and fabricating properties, mild steel is typically used as the cathode substrate, generally in the form of wire screening or perforated sheet.

Prior to being coated, the surfaces of the cathode substrate are preferably cleaned to remove any contaminants that could diminish adhesion of the coating to the cathode substrate by means such as vapor degreasing, chemical etching, electrolcleaning in a proprietary cleaner common in the electroplating arts, and the like, or combinations of such means.

All or only part of the cathode surface may be coated depending on the type of electrolytic cell in which the cathode is to be employed. For example, when the cathode is employed in halo-alkali cells wherein a diaphragm is deposited directly upon the side of the cathode which faces the anode, only the nonfacing interior portions of a cathode tube will be electrolytically active and, thus, only the interior surfaces need be coated. Alternatively, when a cathode is used in halo-alkali electrolysis cells having a diaphragm or membrane which is spaced from the cathode, both sides of the cathode are electrolytically active and must be coated.

In order to avoid confusion, the term "electrolysis anode" will be used in this specification to indicate the anode used in the normal electrolytic process to produce chlorine in a halo-alkali cell. Similarly, the term "plating anode" will be used to indicate a soluble or insoluble anode used for the electrodeposition of an electroplated metal coating on the cathode substrate.

In a common electrolysis cell, cathode tubes 16 are each in the form of a narrow vertical rectangular box and are generally spaced a distance of about 2.5 inches from an adjacent parallel cathode tube. A diaphragm, usually an asbestos material or asbestos modified by polymer fibers is deposited on the outside surfaces of each cathode tube. Electrolysis anodes are positioned intermediate the adjacent pairs of parallel cathode tubes 16. As is known, in the operation of the cell, brine solution is fed in the area of the anodes where chlorine is evolved at the anodes and the brine passes under hydraulic pressure through the diaphragm to the interior of the cathode tubes where hydrogen is evolved at the cathode surface, principally on the interior surfaces of the cathode tube. An electrolysis cell A may contain any number of cathode tubes and intermediate anodes, however, 25 to 50 cathode tubes is common for most commercial electrolytic cell installations.

An active coating may be applied to the cathode tubes, and principally to the interior surfaces of the cathode tubes which are electrolytically active by a method in accordance with this invention.

In order to deposit an active metal coating onto the cathode tubes 16 without removing same from electrolysis cell A, the electrolysis cell is emptied of brine solution and the diaphragm coatings on the cathode tubes are also removed by any method known in the art. The anode base and electrolysis anodes are removed from their position in spaces 14 intermediate adjacent pairs of cathode tubes 16. The cathode tubes 16 may then be rinsed and cleaned by any manner common in the plating arts in order to provide a clean surface to the cathode tubes. Any known electrocleaner or proprietary cleaner may be used for this purpose. An acid pickle following cleaning is also common in the plating arts in order to neutralize any residual alkaline cleaner and also to remove any oxides of iron remaining on the cathode tubes 16. This practice does reduce the service life of the cathode material and, thus should be avoided if possible.

The cathode tubes 16 are immersed in an electroplating solution which will deposit an alloy of nickel and zinc, either by sealing the can bottom and filling the can with plating solution, or immersing the entire can in an electroplating tank. The plating solution may be any plating solution common in the art such as a sulfate, sulfamate, fluoborate, pyrophosphate, or the like, but the preferred plating solution is a nickel chloride/zinc chloride bath to be more fully described hereinafter.

Following the introduction of plating solution into electrolysis cell A, a plurality of plating metal anodes 28, best shown in FIGS. 2–5, are positioned within the cell and electrically connected so that the plating metal anodes 28 are anodic and the cathode tubes 16 are cathodic whereby upon application of an electric current, a nickel-zinc alloy is deposited on the surface of the cathode tubes.

Figure 3:
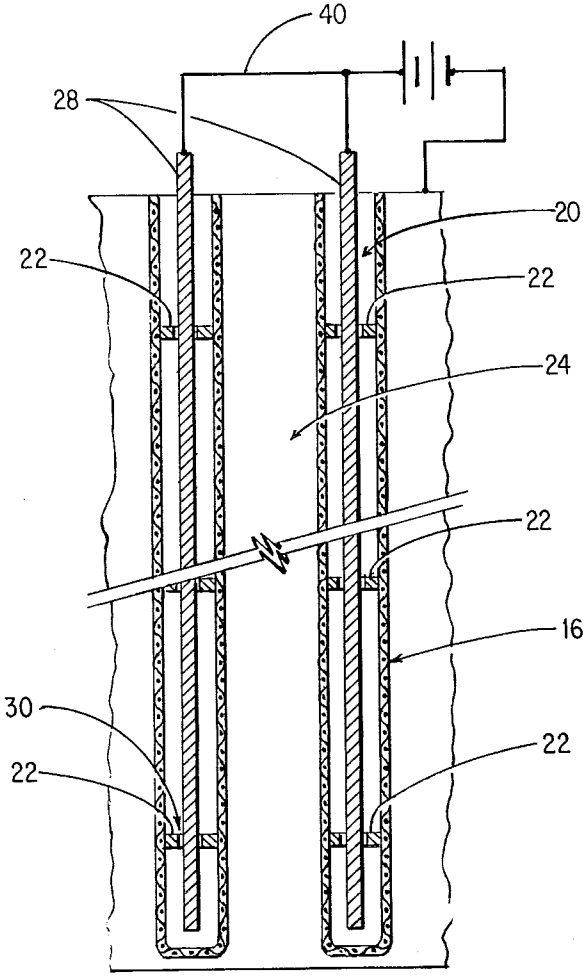
FIG. 3 is a cross-sectional view taken along line 3—3 of FIG. 2.
Figure 2:
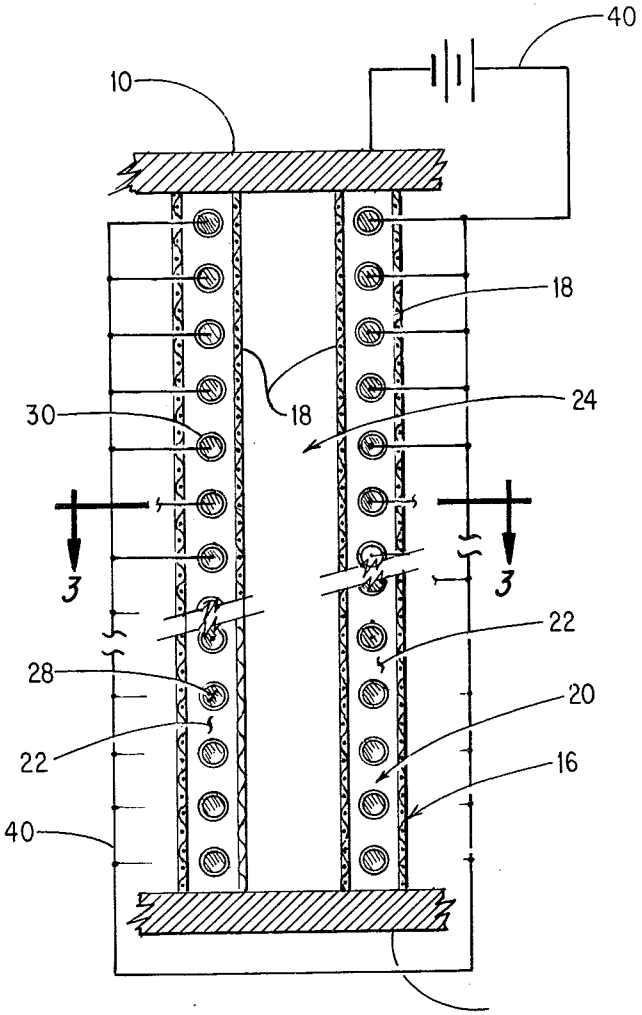
FIG. 2 is a cross-sectional view of the electrolytic cell shown in FIG. 1 taken along lines 2—2 thereof.

The plating metal anodes 28 may be positioned inside the cathode tubes as shown in FIGS. 2 and 3. This is accomplished by opening the tops of the tubes 16 and extending the plating metal anodes vertically within the cathode tube. Common in the structure of cathode tubes 16 are reinforcing spacer members 22 which are disposed in a plurality of parallel horizontal planes within the interior of the cathode tube 16. As best shown in FIG. 2, reinforcing spacer members 22 have a plurality of spaced, circular openings 30 disposed along the transverse width of the cathode tube 16. Each of the openings 30 is aligned vertically with corresponding openings in the parallel reinforcing spacer members 22. It can thus be seen that a plating metal anode 28 of a diameter smaller than openings 30 may be inserted vertically through each of the aligned openings 30 in reinforcing spacer members 22 and the desired coating may be deposited on the interior surfaces of the cathode with only slight deposition of the coating on the exterior surfaces of the cathode tube 16. This results in the application of coating material where it is most needed since the exterior surfaces are generally covered with the diaphragm coating and thus are not electrically active for the electrolysis of brine solution.

Following the deposition of the preferred nickel-zinc coating on the interior surface of the cathode, the plating metal anodes 26 are removed from the cell and the tops of the cathodes are again closed. The plating solution may then be pumped out of the cell and the cell rinsed and a diaphragm reapplied to the exterior cathode surfaces whereby the electrolytic cell A may be returned to use in the electrolysis of alkali-halide brines.

It is also preferred that prior to the deposition of the diaphragm following electroplating, that the coated cathodes be leached in a solution of sodium hydroxide in order to remove all or a portion of the zinc component of the electrodeposited coating. It will be understood however that this is merely a preferred method of treatment and it is entirely possible to put the cell in use immediately for the production of chlorine and caustic, the caustic produced during the electrolysis effecting the leaching of the zinc from the coated cathode. If contamination by zinc ion presents a problem in the production of caustic, however, it would be necessary to leach the coatings prior to placing same into use in production.

Figure 7:
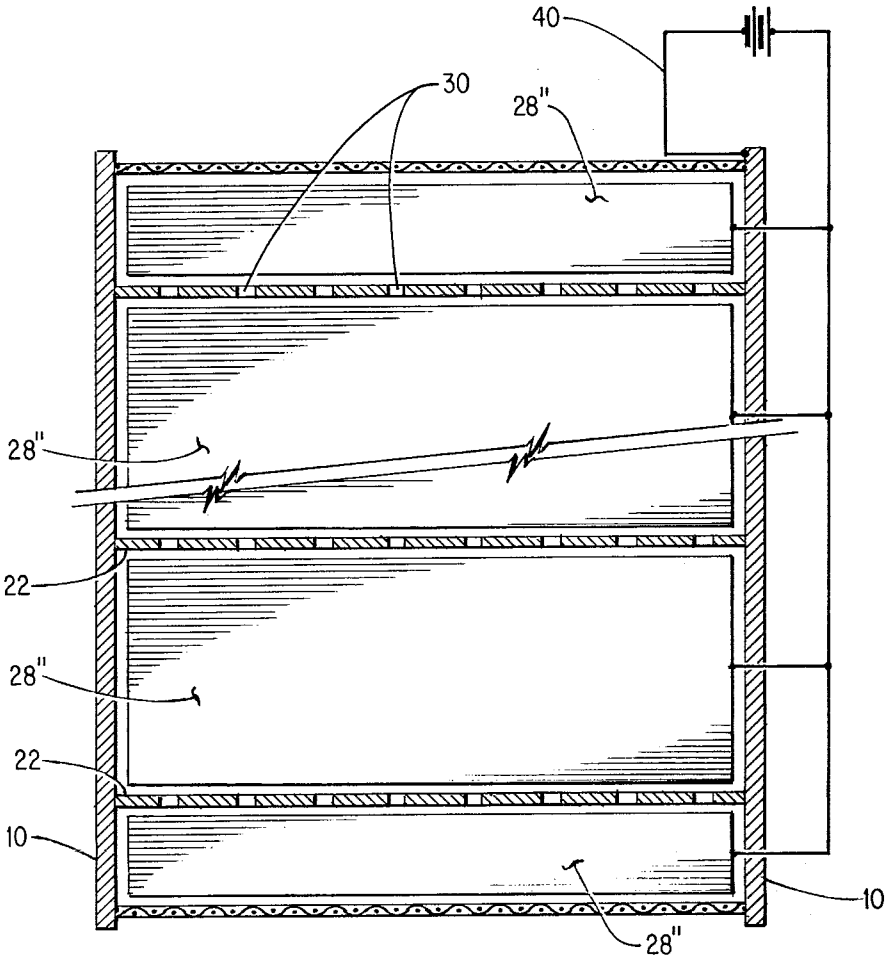
FIG. 7 is a cross sectional view taken along line 7—7 of FIG. 6.
Figure 6:
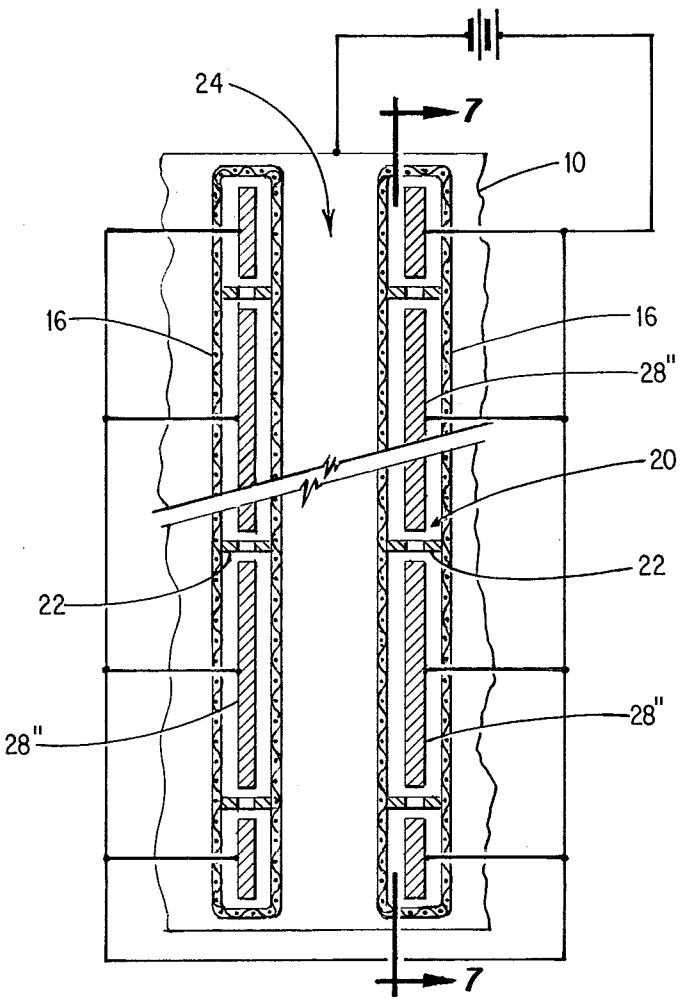
FIG. 6 illustrates an alternate method in a view similar to that shown in FIGS. 2 and 4.

An alternative for the positioning of anodes within the cell would be to open the sides 10 of the cathode can and to slide bar form anodes 28″ into the tubes 16 transversely of the cathode tubes and parallel to the reinforcing spacer members 22 such as shown in FIGS. 6 and 7, while utilizing the remaining steps of the above-outlined method of plating.

Figure 5:
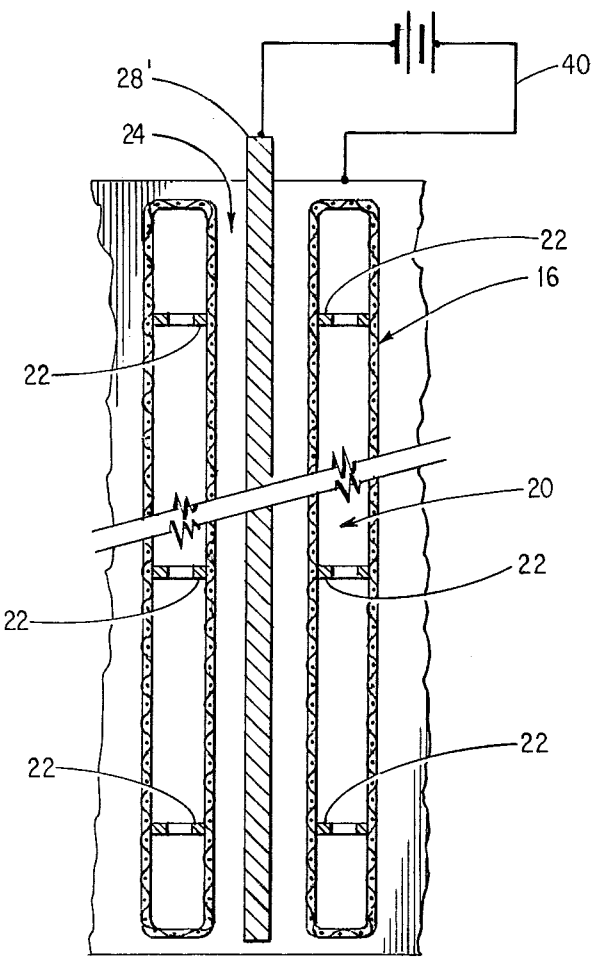
FIG. 5 is a view similar to FIG. 3 taken along line 5—5 of FIG. 4.
Figure 4:
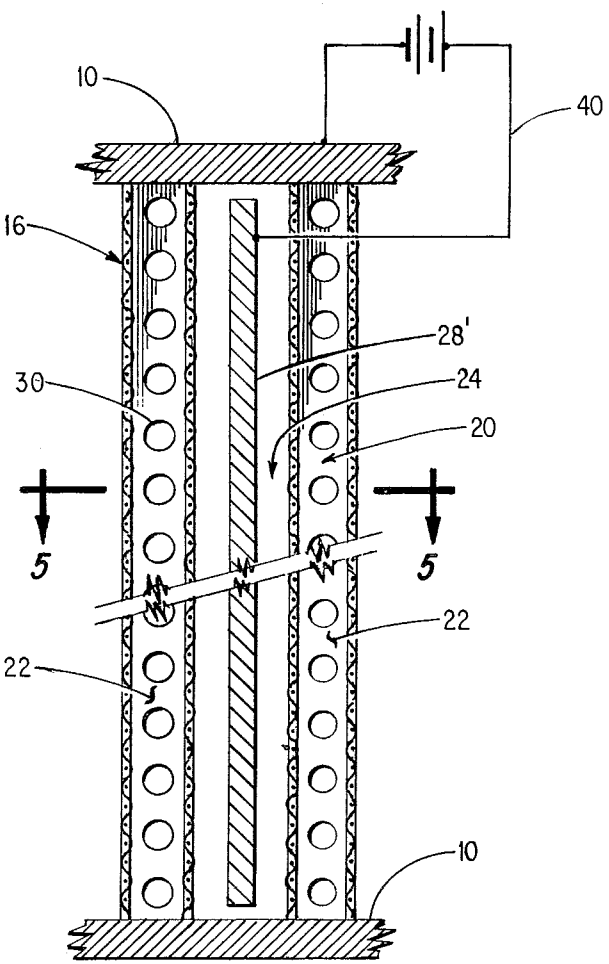
FIG. 4 illustrates an alternate method in accordance with the invention in a view similar to that shown in FIG. 2.

Another alternative method of positioning plating metal anodes within the cell is contemplated within the scope of this invention and illustrated in FIGS. 4 and 5. It is often impractical to open the tops of cathode tubes so that interior plating metal anodes 28 may be positioned therewithin. Therefore, plating metal anodes 28′ of a planar form may be positioned along the exterior of the cathode tubes 16 intermediate adjacent tubes in a position generally corresponding to the position of electrolysis anodes during normal production. The above-outlined steps of the plating method are employed, with only the step of positioning the anode exteriorly of the cathode tubes rather than interiorly thereof being changed in the method.

With the external positioning of the anodes, a heavier coating of nickel-zinc alloy is applied to the exterior surface of the cathode tube than on the interior surface thereof as would be expected. It is therefore necessary to increase the length of time of plating so as to obtain sufficient coating on the interior surface of the cathode tubes 16. Thus this method is less economical with regard to plating time and coating metal deposited than the other two methods utilizing the preferred internal placement of plating metal anodes. There is some economic set-off with this process, however, since there is no need to violate the structure of the cathode can.

The following examples will illustrate the application of the preferred methods of the invention to use in depositing an active coating of nickel-zinc alloy onto cathode tubes of a common electrolytic cell for the production of halogens and alkali metal hydroxides:

EXAMPLE 1

Referring to FIGS. 2 and 3 for purposes of illustration, an electrolysis cell is opened and the electrolysis anodes removed therefrom. The brine solution is removed and the diaphragm is washed from the exterior surfaces of the cathode tubes 16. The cathode tube mesh sides 18 are spaced approximately 1.1 inches and tubes 16 are 30 inches wide and made of mild steel screening. A plurality of vertically spaced horizontal reinforcing spacers 22 are positioned intermediate the planar screen surfaces 18 interiorly of the cathode tube 16. A plurality of ½-inch openings 30 spaced on ¾-inch centers are disposed along the length of each reinforcing spacer member 22. The openings 30 in each of the plurality of spacer members 22 are vertically aligned. A ¼-inch rod of nickel to be used as a plating anode 28 is positioned centrally within each of the vertically aligned openings 30 and electrically connected through an external circuit 40 as an anode while the cathode 16 is connected cathodically preferably through side wall 10 of the cell A. Upon the introduction of plating solution containing zinc and nickel ions into the cell A, and the electrical connection of the plating metal anode 28 and cathode tubes 16, a nickel-zinc alloy is deposited as a coating on the surface of the steel screening 18 comprising the cathode tubes 16.

The plating solution is a chloride bath having the following composition:

150 – 300 g/l $NiCl_2 . 6H_2O$ (225–275 g/l preferred)
30 – 60 g/l $ZnCl_2$ (40–50 g/l preferred)
Temperature 30°–65° C (45°–55° C preferred)
pH 1.5 – 5.5 (4.5 preferred)
Current density 0.2 to 2 amperes/in$^2$ (0.5–1 asi preferred)
Deposit composition:
25% – 75% Zn (30%–55% preferred)
75% – 20% Ni (70%–45% preferred)

The Ni Zn ratio may range from 3:1 to 1:3, 30–55% Zn, balance Ni being preferred.

Plating metal anodes are preferably nickel but may also be zinc, nickel-zinc alloy, or an insoluble anode material such as catalytically coated titanium or graphite.

The deposition of coating is carried out at an average current density of one ampere per square inch for a period of one hour. This results in a coating having a thickness ranging from 3 to 20 mils and which has a service life of approximately 2 years in chlorine and caustic production. A reduction in the hydrogen overpotential of about 100 millivolts as compared to that of the mild steel substrates is realized when cathodes coated as above are tested in 100 g/l NaOH at 90° C.

EXAMPLE 2

Referring now to FIGS. 4 and 5 for purposes of illustration, the above procedure is followed except that planar plating metal anodes 28' are positioned parallel to the exterior surface of the cathode tubes 16 at an average distance of approximately one inch therefrom and the deposition is carried out again at approximately one ampere per square inch average current density. A 1 hour deposition time results in a service life of approximately one year in chlorine and caustic production for the cathode tube coatings.

It is contemplated within the scope of this invention that all or a plurality of of the cathode tubes of an electrolysis cell will be simultaneously plated to deposit an active nickel-zinc coating on all or some of the cathodes.

Leaching of the zinc component from the coating to activate same may be carried out in any manner common in the art such as treating anodically in a caustic solution, immersing for a length of time in heated, saturated caustic solution, or merely placing the cell in use and allowing leaching to take place during production of caustic and chlorine in the electrolysis cell.

While the invention has been described in terms of a nickel-zinc coating, it is possible to substitute chemical equivalents for either or both of these metals in the subject invention without affecting the result of a lowered hydrogen overpotential at the cathode surfaces. Thus, the nickel component may be replaced with cobalt or an alloy of cobalt and nickel, or ferrous alloys of nickel and/or cobalt. Furthermore, the zinc component may be replaced by cadmium or an alloy of zinc and cadmium.

The plating solution utilized in the present invention may include proprietary or known levelers and brighteners in common use in the plating arts. Additionally, the operating temperature of the preferred plating solution is optimized at 45°–55° C, however, a temperature range of 30°–65° C is possible and contemplated within the scope of the invention.

Since the exterior surfaces of cathode tubes are usually covered with a diaphragm and thus are not electrolytically active during the electrolysis of brine solutions, it is possible and therefore contemplated within the scope of the invention to coat the outer surfaces of the cathode tubes with a dielectric material or "stop-off" so as to reduce or totally eliminate deposition of alloy coating on these surfaces. This practice results in a lowering of the overall cost of plating metals and further assists in the deposition of improved coatings on the electrolytically active surfaces, that is, the interior surfaces of the cathode tubes.

While the method of the invention has been described in the more limited aspects of preferred embodiments thereof, other methods have been suggested and still others will occur to those skilled in the art upon the reading and understanding of foregoing specification. It is contemplated that all such methods be included within the scope of the appended claims.

What is claimed is:

1. A method of in situ electrodeposition of a nickel-zinc alloy coating onto surfaces of cathode tubes disposed within a cathode can of an electrolysis cell for the production of ahlogens and alkali metal hydroxides, said cathode tubes each having a pair of vertically oriented parallel foraminous planar side walls each having outside surfaces and facing inside surfaces and a catholyte space intermediate said inside surfaces and a plurality of horizontally disposed spacer members connecting said inside surfaces of each of said pair of foraminous side walls and having vertically aligned openings therethrough, the method which comprises:

cleaning and rinsing said cathode can;

immersing said cathode can in a plating solution containing nickel ions and zinc ions;

immersing plating anodes within said cathode can and parallel to said cathode tubes;

electrically connecting said plating anodes and said cathode tubes to a source of direct current so that said plating anodes are anodic and said cathode tubes are cathodic;

electrodepositing a nickel-zinc alloy coating on said inside and outside surfaces of said cathode tubes;

removing said anodes and said plating solution from said electrolysis cell, and leaching said coating to remove at least some zinc therefrom whereby said cell may be placed in use for the production of halogens and alkali metal hydroxides.

2. The method as described in claim 1 wherein the step of immersing said plating metal anodes includes the step of positioning said anodes internally of said cathode tubes.

3. The method as described in claim 2 wherein the step of immersing said anodes includes the step of positioning a plurality of rod form plating metal anodes vertically intermediate said inside surfaces of said cathode tubes, said anodes passing through said openings in said spacer members whereby a large portion of the deposited metal is located on the inside surfaces of the cathode tubes.

4. The method as described in claim 2 wherein the step of immersing said anodes comprises the steps of opening said cathode can and positioning bar form plating metal anodes horizontally within each of said cathode tubes.

5. The method as described in claim 1 wherein the step of immersing said anodes includes the step of aligning a sheet form anode along each of the exterior faces of said cathode tubes.

6. A method of in situ electrodeposition of a nickel-zinc alloy coating, said coating comprising about 25 to 75 percent nickel and about 75 to 25 percent zinc, onto surfaces of cathode tubes disposed within a cathode can of an electrolysis cell for the production of halogens and alkali metal hydroxides, said cathode tubes each having a pair of vertically oriented, parallel foraminous planar side walls each having outside surfaces and facing inside surfaces and a catholyte space intermediate said inside surfaces and a plurality of horizontally disposed spacer members connecting said inside surfaces of each of said pair of foraminous side walls, each of said of horizontally disposed spacer members having vertically aligned openings therethrough, the method which comprises:

cleaning and rinsing said cathode can;

immersing said cathode can in a plating solution comprising an aqueous solution of 150 to 300 grams per liter of nickel chloride, 30 to 60 grams per liter zinc chloride and having a temperature of 30° to 65° C and a pH ranging from about 1.5 to 5.5;

positioning plating metal anodes within said cathode can and parallel to said sidewalls of said cathode tubes;

electrically connecting said plating metal anodes and said cathode can to a source of direct current so that said plating metal anodes are anodic and said cathode can is cathodic;

electrodepositing a nickel-zinc alloy coating on said inside and outside surfaces of said cathode tubes at a current density ranging from about 0.2 to 2.0 amperes per square inch;

electrically disconnecting said plating anodes and said cathode can and separating said cathode can from said anodes and said plating solution, and leaching said coating in a solution of sodium hydroxide so as to remove at least some zinc from said coating whereby said cathode can may be assembled into an electrolytic cell for the production of halogens and alkali metal hydroxides.

* * * * *